United States Patent [19]

Salomon

[11] 4,160,332

[45] Jul. 10, 1979

[54] SKI BOOT

[75] Inventor: Georges P. J. Salomon, Annecy, France

[73] Assignee: Etablissements Francois Salomon et Fils, Annecy, France

[21] Appl. No.: 781,044

[22] Filed: Mar. 24, 1977

[30] Foreign Application Priority Data

Mar. 24, 1976 [FR] France ..... 76 08543

[51] Int. Cl.[2] ..... A43B 5/04

[52] U.S. Cl. ..... 36/119

[58] Field of Search ..... 36/105, 117, 119, 120

[56] References Cited

U.S. PATENT DOCUMENTS 3,530,594 9/1970 Vogel ..... 36/119

3,778,872 12/1973 Rathmell ..... 36/119

FOREIGN PATENT DOCUMENTS 569438 11/1975 Switzerland ..... 36/105

*Primary Examiner*—Patrick D. Lawson

*Attorney, Agent, or Firm*—Pollock, Vande Sande & Priddy

[57] ABSTRACT

A ski boot comprises a shell, a part hinged to the shell, means for closing the hinged part to the shell, a foot-retaining system located between the shell and the skier's foot to enable the skier to immobilize his foot in the boot after he has placed his foot therein. The invention is characterized in that the foot-retaining system is caused to bear against the foot by the hinged part when the latter is moved to be secured to the shell by the closing means.

35 Claims, 23 Drawing Figures

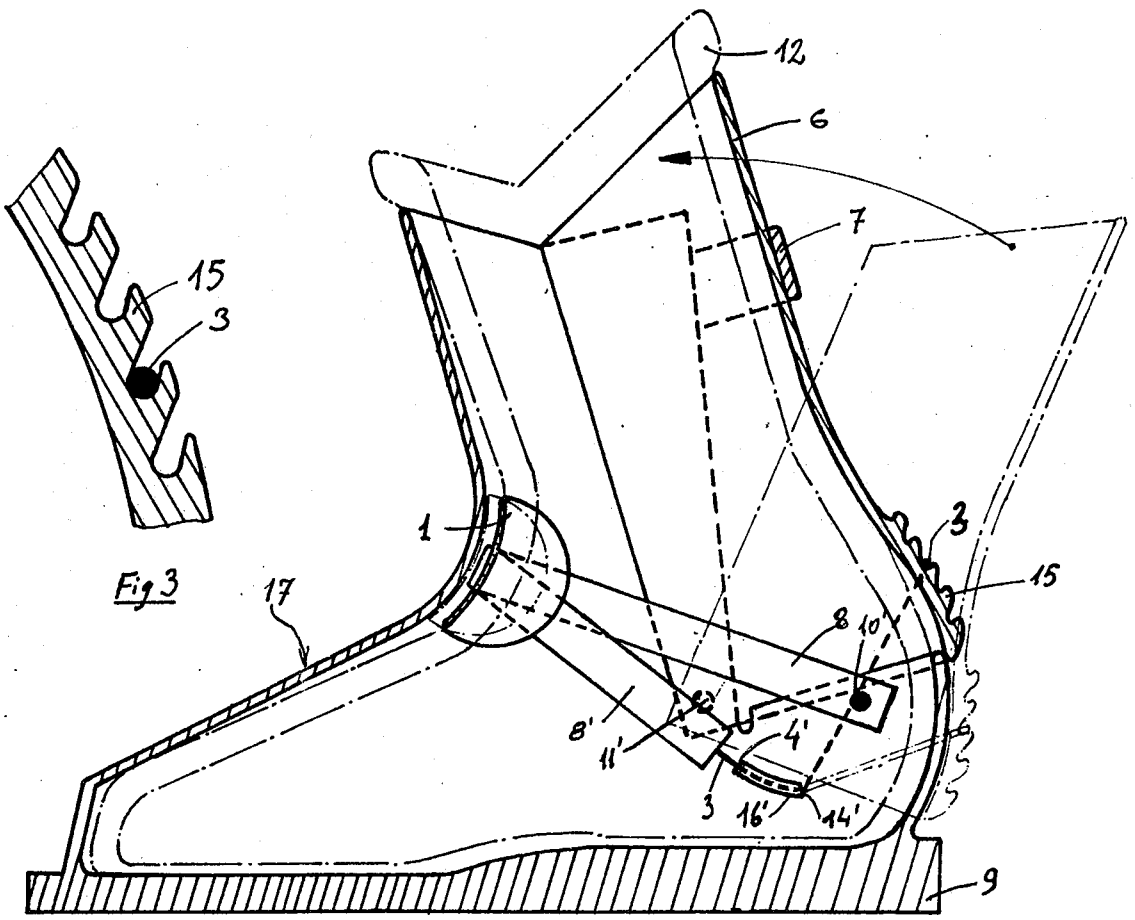
Fig 1
Fig 3
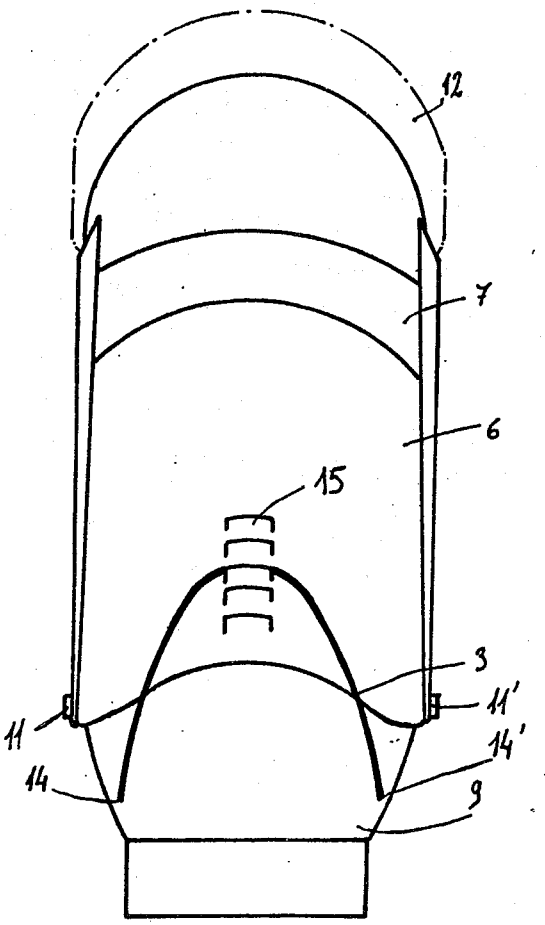
Fig 2

SKI BOOT

The invention relates to a ski boot, more particularly to a boot into which the foot is introduced from the rear, the boot consisting of a shell, a part hinged to the shell, and means for closing the hinged part.

The skier may thus immobilize his foot in the boot after he has placed his foot therein.

The boot furthermore comprises a foot-retaining system located between the shell and the foot.

Ski boots are known which consist of (a) a shell made of plastic material, opening over the top of the foot and closed by means of hooks, the shell being relatively rigid, mainly in order to hold the foot properly and to protect it from impact; and (b) a sock made of a soft and flexible material and interposed between the shell and the foot.

This type of boot conforms to each skier's particular anatomy when the hooks are tightened to a greater or lesser extent, but since the rigidity of the shell makes a wide opening impossible, it is difficult to put this kind of boot on. Moreover, several hooks are required to close the shell properly.

Boots having rear openings, which are easy to put on, have been suggested to solve these problems. Since the length of the opening has been reduced, this kind of boot may be closed with only a few hooks, one or two, for example. However, since in this case the whole front part of the boot is rigid, the closure system is inadequate for proper retention of the foot.

It has therefore been proposed to introduce a system of straps between the shell and the sock, the straps being secured to each side of the shell, passing over the instep, and being drawn to the rear by a system of hooks or the like. This concept appears in French Patent Nos. 1,587,642 (KLEINLAGEL) and 2,045,321 (HEAD SKI), and in U.S. Pat. Nos. 3,529,368 (ROSEMOUNT) and 3,599,351 (ROSEMOUNT).

However, since these foot-retaining systems require the use of an additional hook, boots according to these inventions have the disadvantage of requiring an additional operation when they are put on or taken off.

German Patent No. 2,317,408 (GERTSCH) offers another solution. In this case, foot retention is achieved by hinging a hood to the base of the shell, over the top of the foot, but this arrangement has certain disadvantages: the opening in the hood is superfluous, since the foot does not enter the boot through this part; a seal is required between the hood and the base of the shell, and it requires two parts hinged to the base of the shell, namely the hood and the rear part of the boot.

It is an object of this invention to provide a ski boot into which the foot may be introduced from the rear, and in which the foot is properly held in the closed boot, and putting on the boot requires a limited number of closing operations, so that it can be done simply and quickly.

This object is achieved by providing the ski boot according to the invention with a—a shell, b—a part hinged to the shell, c—means for closing the hinged part onto the shell, and d—a foot-retaining system located between the shell and the foot.

Moreover, according to one basic characteristic of the invention, the foot-retaining system is caused to bear against the foot by direct or indirect action of the hinged part when the latter is moved for the purpose of securing it to the shell by the closure means.

By thus connecting the hinged part to the foot-retaining system in such a manner that the closing (and opening) is related to the tightening (and loosening) of the foot-retaining system, the latter is tightened without the need of a special operating element. The hinged part of the boot is preferably the rear part.

According to another characteristic of the invention, the foot-retaining system, which may be on a level with the metatarsus or instep, is actuated by the hinged part through connecting means. More particularly, the foot-retaining system comprises attachment means which co-operate, through at least one of their ends, with the connecting means. These connecting means, according to the invention, may be in different forms.

According to a first embodiment, the connecting means are in the form of cables assembled to means of attachment and actuated by the hinged part of the boot. In this case, the boot is provided with guide means to orient the direction of traction of the cable and to tension it. The attachment means may consist of two straps surrounding the foot and crossing in the centre plane thereof; in this case, one end of each strap is secured to one side of the boot, while the other end cooperates with the means of attachment. Where the foot-retaining system of a boot having an opening in the rear comprises such means of attachment, the connecting means may consist, with advantage, according to the invention, of a cable hooked by its center portion to an element integral with the hinged part of the boot and secured by its two ends to the corresponding ends of each of the two straps.

This cable thus runs partly inside and partly outside the boot, passing into the boot through two conduits located symmetrically on each side of the shell.

These conduits may be the whole of, or a part of, the guide means, and may cooperate with the cable to tension the means of attachment of the foot-retaining system.

According to a second embodiment, the means of attachment comprise mechanical means for converting a rotary movement into a translatory movement, in such a manner that the translation of the means of attachment of the foot-retaining system is linked with the rotation of the hinged part of the boot. More particularly, according to the invention, the mechanical means may be in the form of a cam-and-ramp system comprising at least (a) a cam connected in rotation to the hinged part, and (b) a ramp connected in translation to the means of attachment cooperating with the ramp.

An element for adjusting the tension of the foot-retaining system may be provided in each embodiment.

The cable-hooking element on the hinged rear part of the boot may, to this end, consist of a plurality of notches integral with the hinged part, or of a hook hinged in relation to the rear part comprising a plurality of notches. This allows the skier to adjust at will the retention of his foot by engaging the cable in one of the notches prior to closing the boot. The cam may be connected in rotation to the hinged rear part of the boot, by an element which allows the cam to be positioned angularly, thus enabling the skier to adjust the tension of the means of attachment of the foot-retaining system.

In each embodiment of the ski boot according to the invention, a foot-retaining system is tightened by the closing of the hinged part of the boot. In a boot of this kind, the straps and guide ramps may be positioned in such a manner that, when the leg is bent forwardly, the hinged part follows the movement of the leg. Under these circumstances, when the leg is bent, the tension of the foot-retaining system is increased, and this increases the retention of the foot at a moment when the heel tends to lift, and this is an additional advantage of the invention. However, if the skier adjusts the foot-retaining system with the rod in the neutral position, the load applied to the foot by the system may be intolerable.

Where the means of connecting the hinged part of the boot to the means of attachment consist of at least one cam mounted upon the hinged part, the cam may comprise a part concentric with the corresponding hinge pivot. This restricts the tension of the means of attachment to a predetermined value.

A detailed description will now be given, by way of example only, of some embodiments of the ski boot according to the invention, in conjunction with the drawings attached hereto, wherein:

FIG. 1 is a side elevation of a boot according to a first embodiment, in cross-section;

FIG. 2 is a rear view of the boot shown in FIG. 1;

FIG. 3 is a detail of the hooking system used in this first embodiment;

Figure 4:
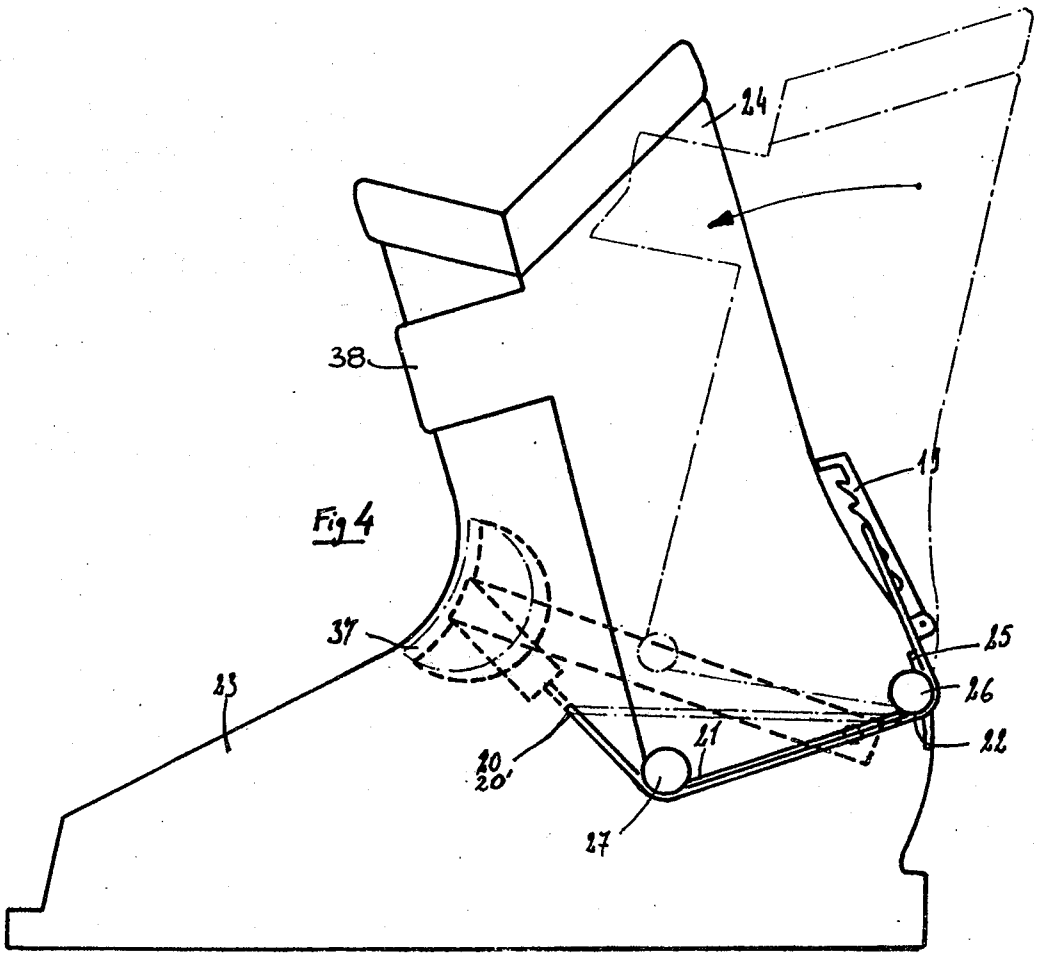
FIG. 4 is a side elevation of a boot according to a second embodiment.

In the foregoing five embodiments, the boot is shown in the closed position, with the open position indicated in dotted lines.

A detailed description will now be given of FIGS. 1, 2 and 3 which illustrate the first embodiment of the boot according to the invention at different angles.

The boot comprises a shell 17 made of rigid materials and a sock 12 made of flexible materials interposed between the shell and the skier's foot.

Shell 17 has a base 9 and a rear part hinged to a spoiler 6. This spoiler is hinged to base 9 of the shell at 11,11'. The boot is closed by rotating spoiler 6 in the direction of the arrow.

After the foot has been introduced into the shell fitted with the sock, spoiler 6 is pivoted onto the front part of the upper and the boot is closed by means of a hook 7, or by a similar system known per se.

Between the shell and the sock, the boot is equipped with a system for retaining the instep which urges the heel in its housing downwardly and towards the rear of the boot. One end of each of straps 8, 8' is secured to each side of the base of the shell at points 10, 10', the straps crossing over each other on the instep, the other ends of the straps being secured to a cable 3. This cable passes through the shell, being guided in conduits 16, 16' integral with base 9 of the shell, or in grooves in the base, from points 4, 4' to points 14, 14'. Cable 3 emerges from the shell at points 14, 14' and is secured to spoiler 6 by an adjusting element consisting of a series of notches 15, the tension of the straps being adjusted by selecting of one of the notches. The pressure is transmitted to the instep or the sock through a distributor plate 1 located between the straps and the sock. When the spoiler is rotated from the open to the closed position, all anchor points 15 for cable 3 are located above the plane defined by points 11, 11', 14 and 14'. Thus the distances between the point at which the cable is hooked to the adjusting element, and the outlet apertures of the conduits, increase when the hinged part (the "spoiler") pivots in the direction of closing according to the arrow. Thus, as it pivots, the spoiler applies, through notches 15, tension to cable 3, and straps 8, 8' apply pressure to the instep through distributor plate 1. In order to remove the boot, spoiler 6 is pulled in the direction opposite to that of the arrow; this loosens the cable, releases the foot, and allows it to be withdrawn easily from the boot.

When he is no longer skiing, and the boot is therefore being used for walking, the skier may release hook 7, thus partially opening the spoiler. This allows the leg to flex freely back and forth and there is less pressure upon the instep. This allows the skier to walk more freely and less painfully.

FIG. 3 shows notches 15 in detail. The distance between the mouths of the notches is less than the diameter of the cable. The latter is therefore held in the relevant notch and remains there when spoiler 6 is opened.

Figure 5:
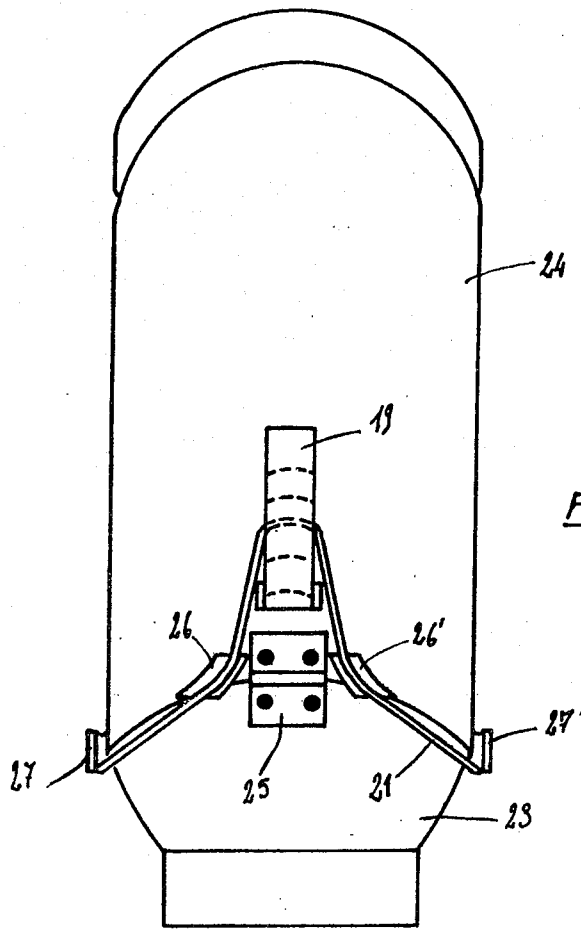
FIG. 5 is a rear view of the boot shown in FIG. 4.

A detailed description will now be given of FIGS. 4 and 5 which show a side elevation and rear view of a second embodiment of the boot. In this case, the boot comprises a shell 23 surrounding the foot and the front of the tibia, and a spoiler 24 covering the rear of the leg and attached to shell 23 by means of a hinge 25, or the like, located near the heel in the center plane of the foot. Spoiler 24 is secured to the front part of the upper by means of a hook 38 or the like.

The boot is equipped with an instep-retaining system comprising straps similar to those described above.

Cable 21 is secured to the free end of each of the straps, emerges from the shell at points 20, 20', and is secured centrally to the spoiler by means of a hinged and notched hook 19 or the like. The cable passes around guides 26, 26' located on spoiler 24. Cable 21 is unguided in the open position between points 20 and 22 (and 20', 22'). When the spoiler is open, cable 21 assumes the position shown in dotted lines in FIG. 4 between points 20 and 22 (and 20', 22'). When the spoiler is closed (in the direction of the arrow in FIG. 4), a guide in the form of a pin 27 (27'), located at the bottom of the spoiler, deforms cable 21 between points 20 and 22 (20', 22'), increasing it by the length of the path it is constrained to follow. This maintains the tension of the cable and thus retains the foot in its housing.

Figure 6:
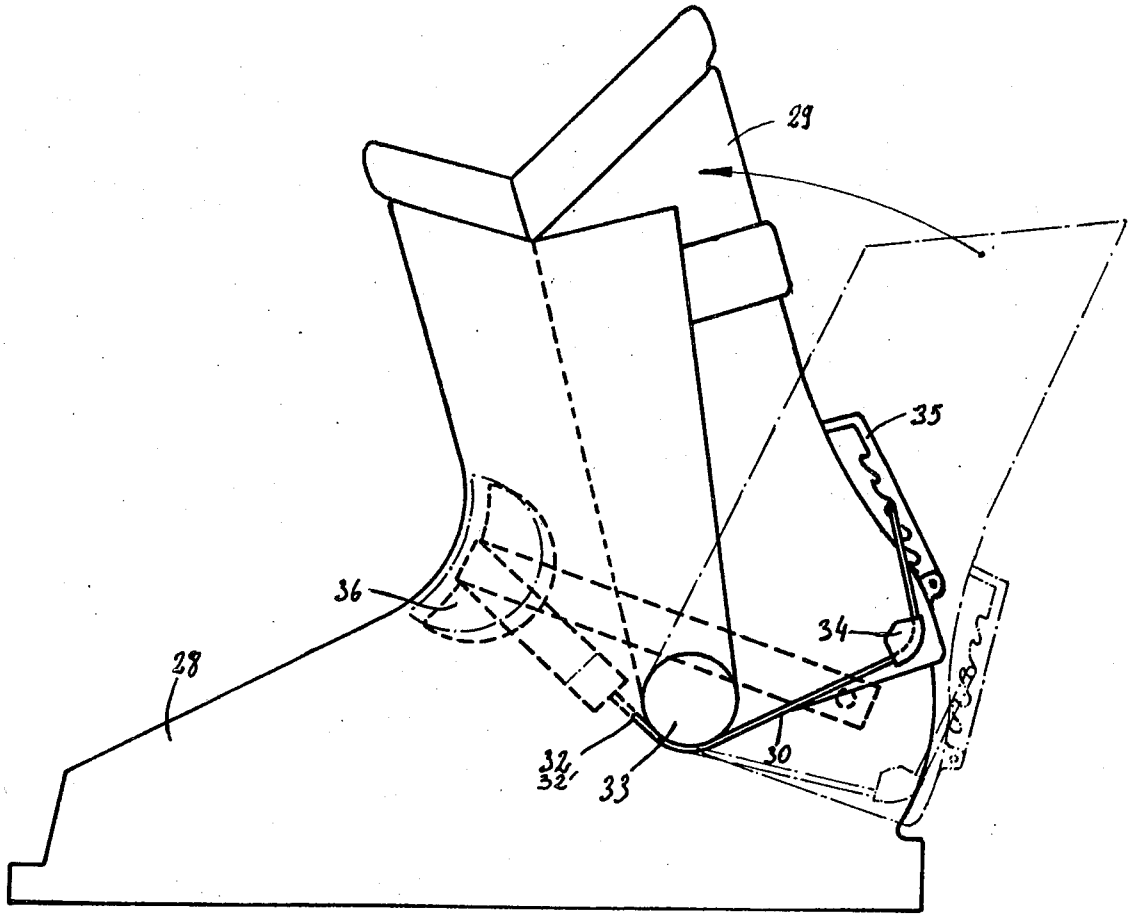
FIG. 6 is a side elevation of the boot according to a third embodiment.
Figure 7:
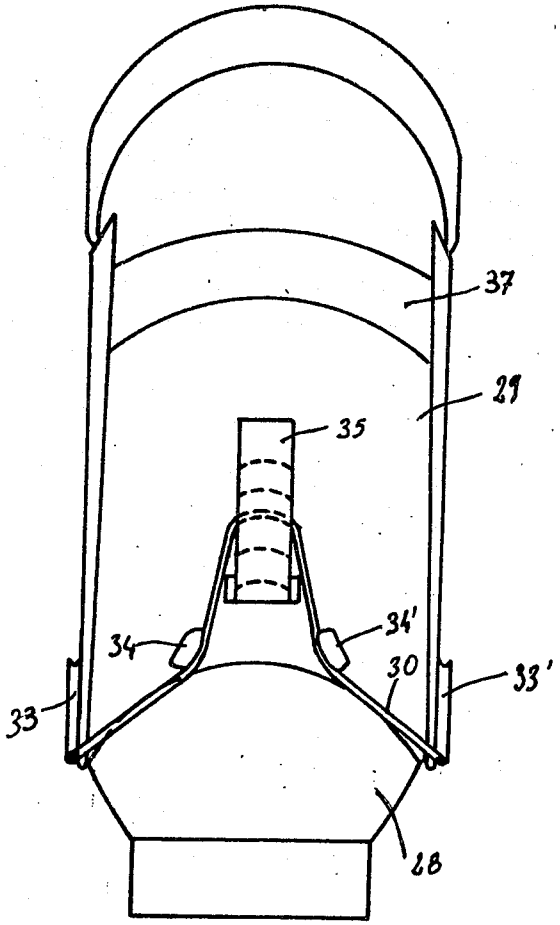
FIG. 7 is a rear view of the boot in FIG. 6.

A detailed description will now be given of FIGS. 6 and 7 which show a side elevation and a rear view of a third embodiment of the boot according to the invention.

The boot comprises a shell 28 surrounding the foot and the front of the leg, and a spoiler 29 hinged to the shell on a level with the tibio-tarsal joint. Spoiler 29 is held to the front part of the upper by a hook 37 or the like. Between the shell and the sock, the boot has an instep-retaining system in the form of the crossed straps described above. A cable 30 is secured to one end of each of the straps and passes through the shell at points 32, 32'. It also passes behind guide ramps 33, 33' which also serve as a hinge for spoiler 29 on the base of shell 28. However, it would also be possible to use guide ramps 33, 33' located in a position other than that of the hinges of spoiler 29 on the base of shell 28. Cable 30 passes behind guides 34, 34' located on the back of spoiler 29 and is tensioned by a hinged and notched hook 35 or the like. When the spoiler is closed, the length of the cable between guide ramps 33 and guide 24 (and 33', 34') remains the same, whereas the length of cable wound around guide ramp 33 (33') increases. This tightens cable 30 and provides satisfactory retention of the foot in its housing.

A detailed description will now be given of FIG. 8 which illustrates a fourth embodiment of the boot according to the invention.

In this case, the boot comprises a shell base 44 surrounding the foot and the front of the bottom of the leg. A spoiler 40, hinged to the shell on a level with the tibio-tarsal joint, is closed onto the front part of the upper by means of a hook 39 or the like. The foot-retaining system comprises a plate 42 arranged between the shell and the sock on a level with the metatarsus, the plate surrounding the metatarsus and cooperating with a strap 43 in order to hold the foot. The ends of strap 43 are secured to cable 41 which is guided on the base of shell 44 by means of a conduit or a groove in the shell. Cable 41 passes through the shell, emerges at points 45, 45', and is tensioned by a system similar to that described in connection with the first embodiment (FIGS. 1 to 3).

Figure 14:
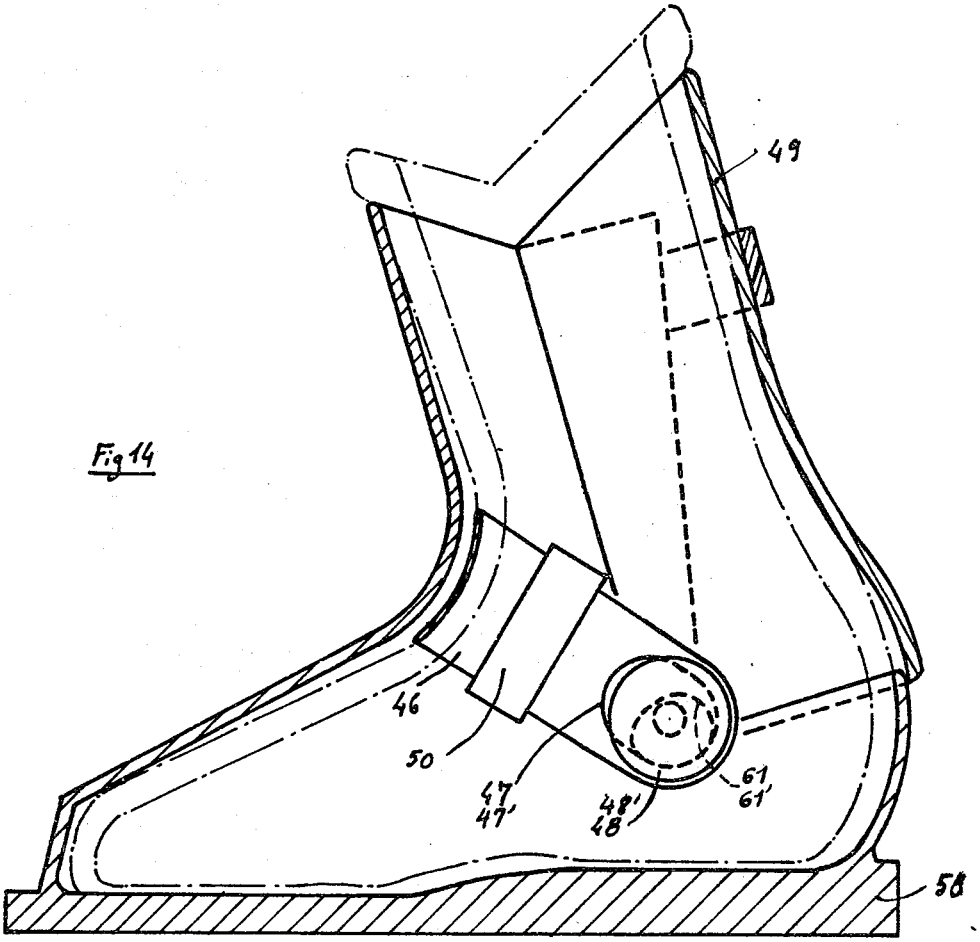
FIG. 14 is a side elevation of the boot according to a fifth embodiment, in cross-section.

A detailed description will now be given of FIG. 14 which is a side elevation, in cross-section, of a fourth embodiment of the boot according to the invention.

The foot-retaining system consists of a plastic or metal strap secured to spoiler 29 on each side of the boot in the vicinity of the tibio-tarsal joint and spreading out over the instep in order to reduce the pressures on the foot. This strap is equipped with ramps in the form of oblong apertures 47, 47' at its ends. Axes 48, 48', fixed permanently or adjustably in rotation to spoiler 49, on each side of the boot, have cam-shaped grooves 61, 61' accommodating strap 46 by means of oblong holes 47, 47'.

When spoiler 49 is closed, cams 61, 61', carried on axes 48, 48', cooperate with the ramps formed by holes 47, 47' to tighten the foot-retaining system.

A description will now be given of FIG. 17 which shows a special cam profile. This cam has two areas: an area A controlling the tension of strap 46, and an area B concentric with the axis of rotation of the spoiler for which the strap tension is not altered. This area B thus makes it possible to limit the pressure applied by the strap to the foot.

Figure 15:
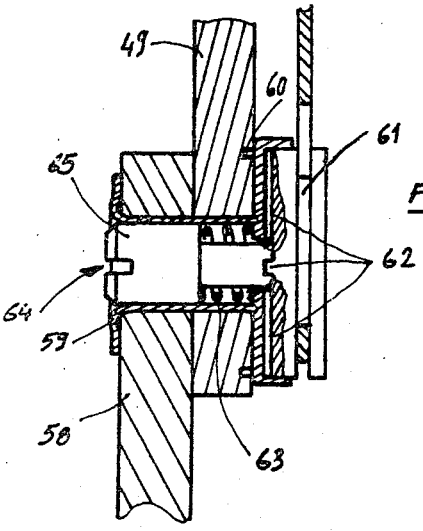
FIG. 15 is a cross-sectional view of one form of cam assembly forming a part of the connecting means between the hinged part and the foot-retaining system, according to the fifth embodiment.
Figure 16:
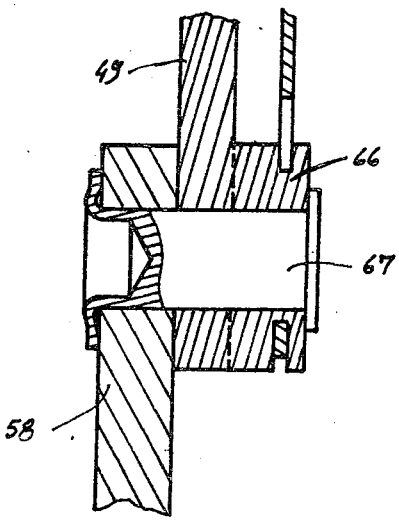
FIG. 16 is a cross-section of another form of cam assembly.

A description will now be given of FIGS. 15 and 16, showing two variants of the cam assembly. In the example illustrated in FIG. 15, the angular setting of the cam is adjustable. Spoiler 49 and the base of shell 58 have holes in the vicinity of the tibio-tarsal joint. An element 59, comprising a tubular part and one end in the form of a flange, has its other end bent to provide a hinge for spoiler 49 on the base of shell 58.

The flange of part 59 has peripheral pins 60 assuring that part 59 rotates with spoiler 49. Cam 61 is caused to rotate with spoiler 49 by means of radial notches 62. These notches engage with those in the flange under the action of a spring 63. The angular setting of cam 61 is adjusted by introducing a screwdriver or a coin into slot 64 in part 65 integral with cam 61, pushing part 65 against the action of spring 63, and thus adjusting the setting of the cam. This angular setting may be referenced, for example, by a radial index on part 65 and a circular scale on the outside of tube 59.

In the embodiment illustrated in FIG. 16, cam 66 cannot be adjusted. It may be molded directly with spoiler 49, or fitted thereto non-adjustably. An axis 67 allows the spoiler to pivot on the base of shell 58.

A detailed description will now be given of FIGS. 18, 19, 20 and 21 which are diagrams showing the pressure applied by the foot-retaining system as a function of the angle of rotation of the hinged rear part (or spoiler).

The angle $A_0$ is the neutral angle of the spoiler, i.e., the position half-way between the front support and the rear support.

Figure 18:
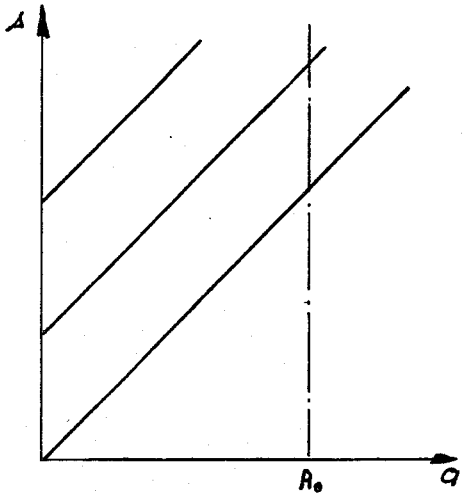
FIGS. 18, 19, 20, 21 are diagrams showing the clamping action of the foot-retaining system as a function of the angle of rotation of the rear hinged part.

FIG. 18 shows the hold obtained with a cam having no part concentric with the hinge for the different angular settings thereof.

Figure 17:
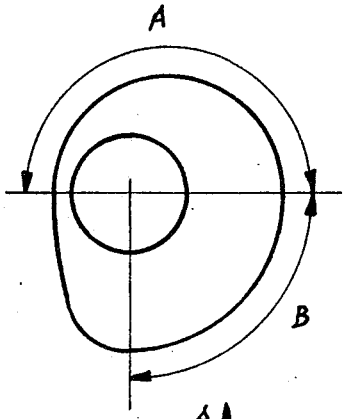
FIG. 17 shows the profile of a special cam which may be a part of the connecting means used in the fourth embodiment of the boot (FIG. 8)
Figure 19:
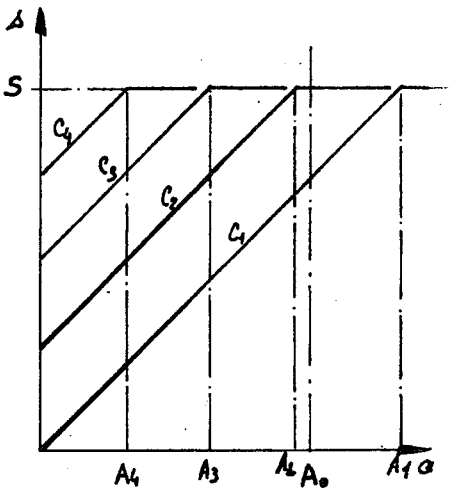

FIG. 19 shows the hold obtained with a cam having a part concentric with the hinge (as shown in FIG. 17) for different settings of the angular position of the cam. It will be noted that the holding action takes place up to an angle $A_1$, $A_2$, $A_3$, $A_4$ (according to the curve and therefore according to the angular setting) above or below the neutral angle $A_0$. The level S of maximal adjustment is constant.

Figure 20:
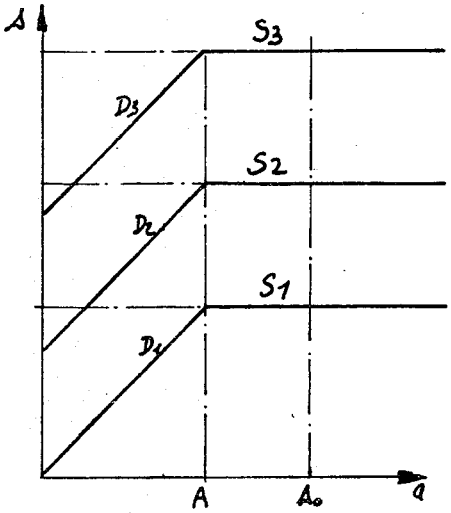

FIG. 20 shows the hold obtained with a cam having a part concentric with the hinge for different adjustments of strap length. What is adjusted in this case is the level of maximal hold ($S_1$, $S_2$, $S_3$), the angle A beyond which there is no longer any hold being constant.

Figure 21:
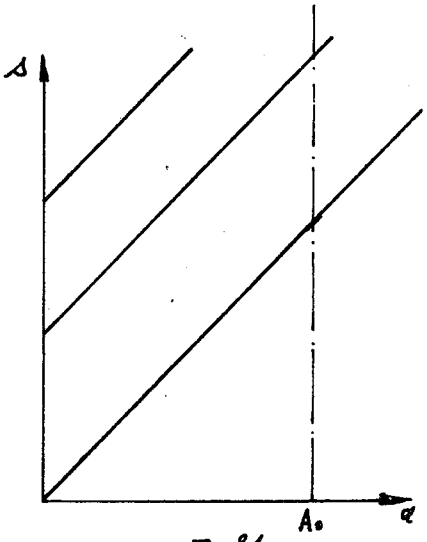

FIG. 21 shows the hold obtained with a cam having a part concentric with the hinge for different adjustments of strap length. These different systems may be combined, the most advanced and complex system consisting of a cam having a part concentric with the hinge and a strap adjustable in length, the angle of the cam being adjustable.

The holding system limited beyond an angle of rotation of the spoiler may be used with a foot-retaining system applying pressure on a level both with the instep and the metatarus.

Figure 9:
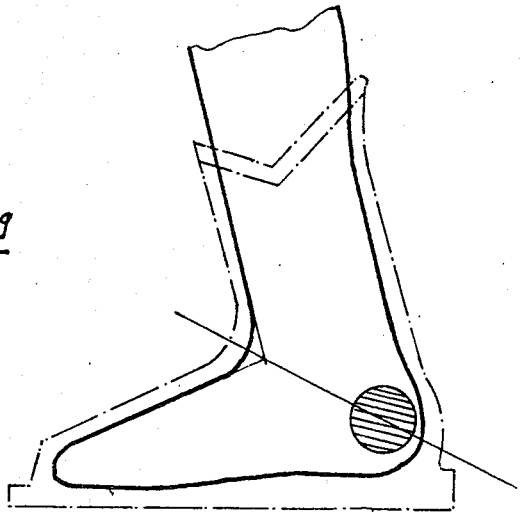
FIG. 9 shows the preferred hooking area for the means of attachment of a system for retaining the metatarsus.

A description will now be given of FIG. 9 which shows the preferred zone for hooking the means of attachment in the case in which the foot-retaining system acts on a level with the instep. In this figure, the zone in which the crossed instep straps are preferably secured to the base of the shell is shown hatched. By locating this zone as far as possible from the flexure fold, the foot is surrounded to the maximal extent and the foot retention is therefore at its maximal effectiveness. Furthermore, the straps are located upon the bisector of the plane angle formed by the front of the leg and the top of the foot, the foot being within the boot and the leg being oriented in accordance with the neutral angle of the boot (the intermediate position between the front and rear supports).

Finally, the straps are fitted to the shell in areas remote from the instep (the flexure fold) and substantially adjacent the bisecting plane, so that automatic positioning of the straps at the flexure fold is facilitated regardless of the morphology of the foot.

The strap, secured in the hatched area on one side of the boot, passes over the instep and is tightened on the other side of the boot substantially along the bisector of the angle previously defined.

Figure 10:
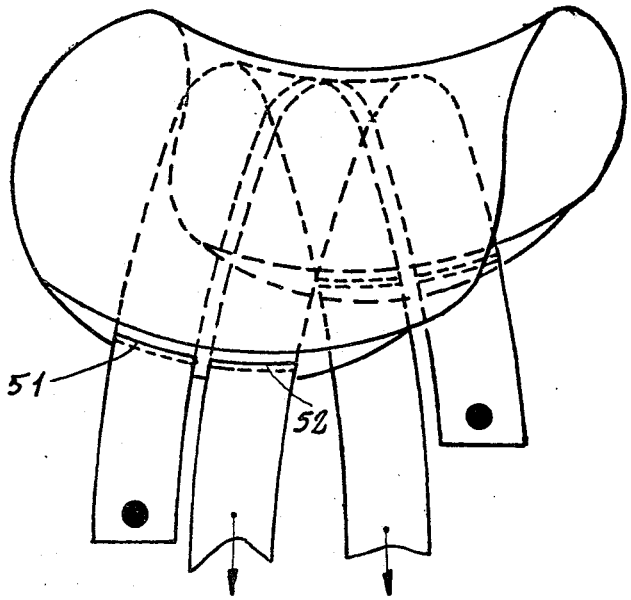
FIG. 10 is a detail of a support element comprising a distributor plate.

A description will now be given of FIG. 10, which shows a detail of a support element comprising a distributor plate.

The instep or metatarsal straps, constituting the means for tensioning the foot-retaining system, preferably transmit the loads through support elements consisting of distributor plates shaped substantially to match the foot. These plates, marked 1, 36, 37 and 42 in FIGS. 1, 6, 4 and 8 respectively, may act upon the sock or the foot, but, in the interest of fast comfort, the latter is not recommended. If the two straps are arranged one above the other, friction may arise between them, especially if the straps move in opposite directions, and this makes the holding action of the straps ineffective. The straps may be arranged side by side or, as shown in FIG. 10, in grooves 51, 52. Thus straps sliding in opposite directions are kept away from each other, and friction between them is eliminated.

According to another form of execution, not shown in detail, one strap may be located in a groove while the other is above the distributor plate. This also eliminates unwanted friction.

Figure 11:
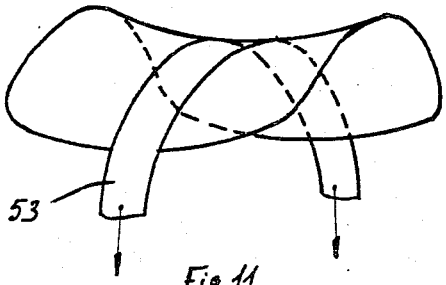
FIG. 11 shows one example of using straps as the means of attachment.
Figure 12:
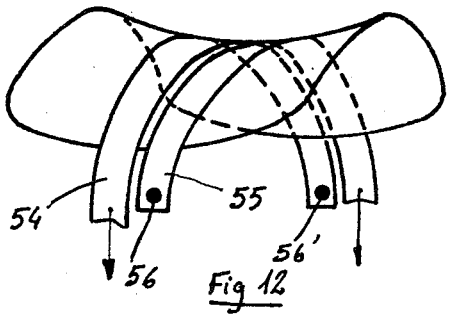
FIG. 12 shows a second example of using straps as the means of attachment.
Figure 13:
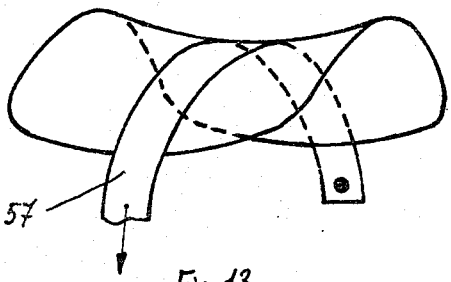
FIG. 13 shows a third example of using straps as the means of attachment.

A description will now be given of FIGS. 11, 12 and 13, showing three designs of attachment means using straps.

FIG. 11 shows a strap 53 the two ends of which are tensioned by a cable or the like (this is a strap arrangement applicable, for example, to the fourth embodiment of the boot).

FIG. 12 shows a system comprising two crossed straps 54, 55, each having one end secured at points 56, 56' and the other end secured to a cable or the like (this arrangement is applicable to the first three embodiments of the boot).

In FIG. 13, the boot has a single strap 57, one end of which is secured to one side of the boot and the other to a cable or the like.

In FIG. 11, the loads applied are symmetrical, but the straps do not surround the foot completely. FIG. 13 shows the solution least recommended, since not only does the strap fail to surround the foot completely, but the loads applied are not symmetrical. The preferred embodiment is that shown in FIG. 12, since in this case the straps surround most of the foot and the loads applied to the foot are symmetrical.

Figures 22, 23:
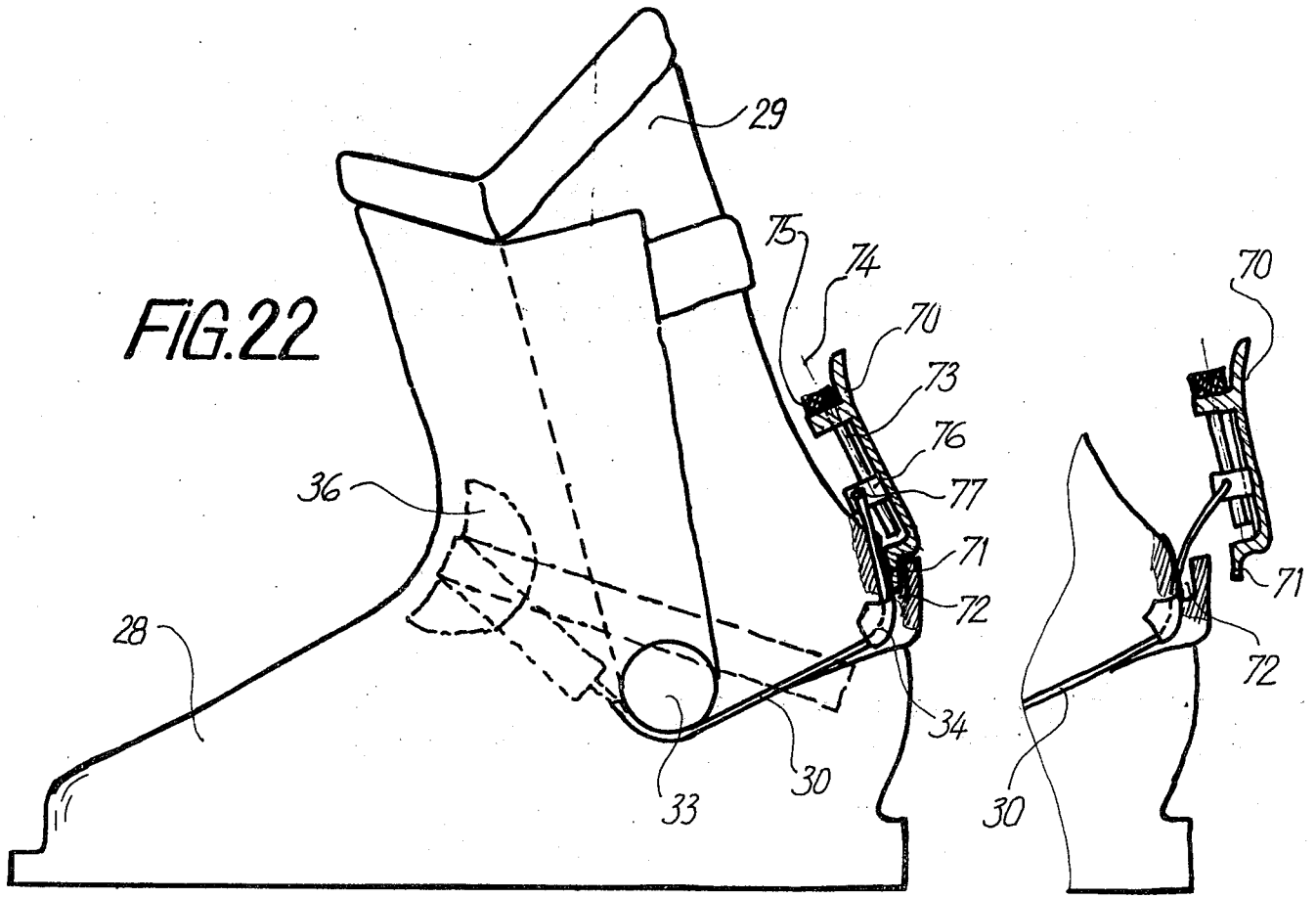
FIG. 22 is a variant of the boot shown in FIG. 6, which differs from the latter mainly in that the hinged part has a detachable means for adjusting the tension of the connecting cables actuating the foot-retaining system.
FIG. 23 is a detail of the boot in FIG. 22 showing the means for adjusting the tension of the foot-retaining system disconnected from the hinge part.

A description will now be given of FIG. 22 which shows a variant of the boot illustrated in FIG. 6 (in FIG. 22, the parts already described in connection with FIGS. 6 and 7 bear the same reference numerals); in this case, cable 30 is tensioned by a detachable adjusting means operable by the skier. This adjusting means 70 is mounted upon the hinged part 29 of the boot by means of a finger 71 which fits into a recess 72 located at the lower end and upon the back of spoiler 29. The adjusting means comprises a threaded rod 73 which rotates about its axis 74 and may be turned by the skier by means of a knurled knob 75; the rod carries a nut 76 comprising an element to which cable 30 may be hooked, the hooking element consisting mainly of the nut 76 through which cable 30 is threaded. FIG. 23 shows the adjusting means disconnected, finger 71 having been withdrawn from recess 72.

This adjusting means allows the skier to vary the tension in the foot-retaining system. The fact that the adjusting means is detachable has the advantage of preventing it from being torn off or damaged when in the disconnected position.

Thus when the hook is permanently hinged to the spoiler, it may assume horizontal positions and may be bent or damaged by striking obstacles on the terrain (a stair, etc.). If, on the other hand, it is detachable, it may freely occupy any position, depending upon the obstacle encountered, and there is no danger of its being bent. Finally, as regards production, it is less difficult to make a detachable means of adjustment than a hinged one, and the former may be simply fitted into the spoiler.

Figure 8:
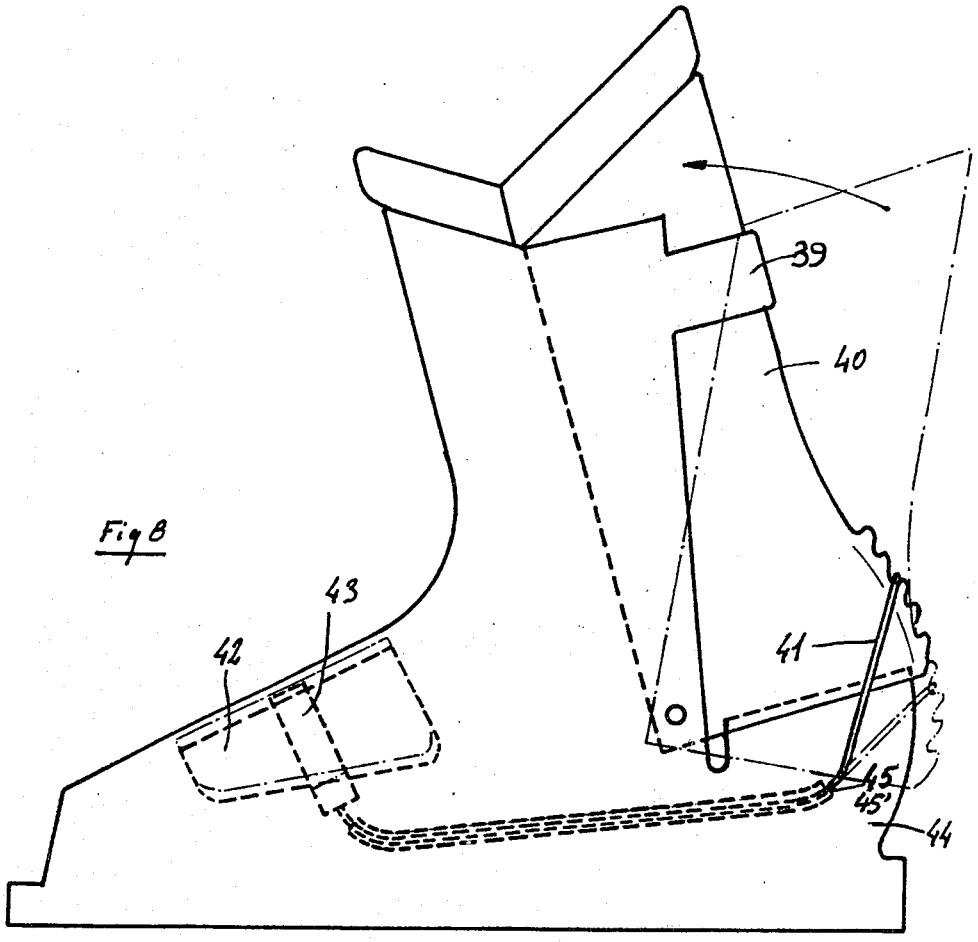
FIG. 8 is a side elevation of the boot according to a fourth embodiment.

In the case of FIGS. 1 and 8, adjusting notches 15 are integral with the hinged part, and the spoiler is therefore closed by "direct" action. In the cases of FIGS. 4, 6, 22, however, this action is considered "indirect" since, when the spoiler is closed, the closing action on the cables is not total; it becomes total only when rear hinged hook 19, 35, or detachable adjusting means 70, is actuated, which actually completes the closure for a given adjustment. (These latter embodiments could, in fact, be regarded as "direct action" means, especially if the hinged hooks or detachable adjusting elements, adjusted by tensioning selected cables, are folded down onto the hinged part which has remained open, and when the latter is closed onto the bottom of the leg).

The advantages of this indirect action are that, with the spoiler still secured to the bottom of the leg, the cables may be partly relaxed (when the skier is waiting or is on the ski lift) by opening the rear hook or disconnecting the detachable adjusting element.

All of the embodiments described above in detail use a foot-retaining system controlled by the rear hinged part, or spoiler. However, a foot-retaining system acting upon the instep or metatarsus, arranged in a boot opening at the front, and controlled by closing a hood located above the metatarsus, is possible.

The advantage of such a foot-retained system is that the foot enters the boot easily. The foot-retaining straps may be replaced by metal bands. If only one strap is used, it may be injected in one piece with its distributor plate.

In the first, third and fourth embodiments of the ski boot according to the invention, a cable is displaced transversely in relation to the shell and/or spoiler. Advantage may be taken of this displacement to cause the cable to slide along a ramp at the bottom of the shell or spoiler, for the purpose of increasing the tension of the foot-retaining system. Or this system may be used alone to tension the foot-retaining system. The various designs of the elements in the ski boot according to the invention may also be combined, without departing from the scope of the said invention.

What is claimed is:

1. A ski boot comprising:
(a) a shell comprising a fixed part and a part hinged to said fixed part;
(b) means for closing said hinged part on said fixed part; and
(c) a foot-retaining system located between said shell and a skier's foot to enable the skier to immobilize his foot in the boot after placing his foot therein;
(d) said foot-retaining system being caused to bear against the foot by said hinged part when the latter is moved to be secured to said fixed part by said closing means.

2. A ski boot according to claim 1, wherein said hinged part of the boot is the rear part of the boot upper to enable the skier to introduce his foot through the rear of the boot.

3. A ski boot according to claim 1, wherein said foot-retaining system is on a level with the skier's metatarsus.

4. A ski boot according to claim 1, wherein said foot-retaining system is on a level with the skier's instep.

5. A ski boot according to claim 1, comprising an internal sock made of a soft material, said ski boot being characterized in that said foot-retaining system, actuated by said hinged part, is located between said sock and said shell.

6. A ski boot according to claim 1, wherein said foot-retaining system is caused to bear against the foot, by the hinged part, through connecting means.

7. A ski boot according to claim 6, wherein said foot-retaining system comprises attachment means co-operating, by at least one of their ends, with said connecting means.

8. A ski boot according to claim 6, wherein said foot-retaining system comprises attachment means secured by their ends to said shell, on the one hand, and to said connecting means, on the other hand.

9. A ski boot according to claim 7, wherein said foot-retaining system attachment means are in the form of a strap surrounding the foot.

10. A ski boot according to claim 8, wherein said attachment means are in the form of two straps surrounding the foot and crossing over each other in the centre plane of the foot, one end of each of the straps being secured to one side of the boot, while the other end co-operates with said connecting means.

11. A ski boot according to claim 1, wherein said foot-retaining system actuated by the hinged part of said shell comprises a support element in the form of a plate, said plate having a shape matching substantially that of the foot whereby pressure is transmitted to the foot over a wide area.

12. A ski boot according to claim 11, wherein said foot-retaining system attachment means are in the form of a strap surrounding the foot; said support element being placed between said strap and the foot.

13. A ski boot according to claim 10, wherein said foot-retaining system actuated by said hinged part of said shell comprises a support element in the form of a plate, said plate having a shape matching substantially that of the foot; said support element located between the straps and the foot comprising means for separating straps sliding in opposite directions thereby eliminating friction between the straps possibly leading to an uncomfortable arrangement of said support element.

14. A ski boot according to claim 8, wherein said foot-retaining system is on a level with the skier's instep; said connecting means being located substantially in the plane bisecting the angle formed by the front of the leg and the top of the foot, the foot being within the boot and the leg being oriented along the neutral angle of the boot; said means of attachment being secured to the shell in areas remote from the instep and substantially adjacent said bisecting plane.

15. A ski boot according to claim 10, wherein said connecting means are cables secured to said means of attachment and actuated by the hinged part of the boot; said guide means being provided in the boot to orient the direction of traction of the cable and to tension it.

16. A ski boot according to claim 15, wherein said hinged part is the rear part of the boot upper; said connecting means consisting of a cable hooked by its centre to a hooking element integral with said hinged part of the boot, the ends of said cable being secured to corresponding ends of each of the two straps; said cable running partly inside the boot and partly outside the boot, passing therethrough by means of two conduits located symmetrically on each side of the shell.

17. A ski boot according to claim 16, in which said hinged part of the boot is hinged by two pivots located on each side of said shell, said conduits passing through said shell and constituting the guide means being arranged, in relation to the pivots, in such a manner that the distances between the point where the cable is hooked by the hooking element integral with said hinged rear part of the boot, and the outlet apertures of said conduits, increase when the hinged rear part pivots in the direction of closing.

18. A ski boot according to claim 16, said guide means consisting:
partly of the conduits passing through said shell, and
partly of a single guide for the hinged rear part, designed to co-operate with the cable when said hinged part is being closed, by increasing the length of the path along which it is constrained to travel whereby the cable and the means of attachment of the retaining system are tensioned.

19. A ski boot according to claim 16, said guide means consisting:
partly of the conduits passing through said shell, and
partly of guide ramps integral with at least one of the following elements: the shell and the hinged rear part, said ramps being arranged in a manner such that the relative movement of the two elements, during closing, extends the path along which the cable is constrained to travel as it slides along the ramps whereby the cable and the means of attachment of the retaining system as the hinged rear part of the shell is closed.

20. A ski boot according to claim 19, said guide ramps being further arranged in a manner such that flexure of the boot upper lengthens the path along which the cable is constrained to travel as it slides along the ramps whereby the cable and the means of attachment of the retaining system are subjected to additional tension when the skier carries out a bending movement tending to lift the heel.

21. A ski boot according to claim 10, wherein said connecting means comprise mechanical means for converting rotary movement into translatory movement, said mechanical means being, in part, connected in rotation to the hinged part of the boot and, in part, connected in translation to the means of attachment of the retaining system.

22. A ski boot according to claim 21, wherein said mechanical means are in the form of a cam and ramp system comprising at least:

a cam connected in rotation to the hinged part, and a ramp connected in translation to the means of attachment co-operating with said ramp.

23. A ski boot according to claim 22, wherein said hinged part is the rear part of the boot upper; said hinged part being hinged to two pivots located on each side of said shell; a cam being mounted upon said hinged rear part of the boot and rotating about at least one of said pivots; a ramp, in the form of an oblong hole, being arranged at the end of at least one of the two straps whereby said straps are tensioned as the hinged rear part of the boot is closed.

24. A ski boot according to claim 23, said cam comprising a part concentric with the corresponding hinge pivot whereby strap tension may be limited to a predetermined value.

25. A ski boot according to claim 22, said cam being connected in rotation with the hinged rear part of the boot through an element for adjusting the angular position of the cam whereby strap tension may be adjusted at will by the skier.

26. A ski boot according to claim 16, said hooking element being adjustable and comprising a plurality of fixed notches integral with said hinged part of the boot, said cable being engaged by the skier at will in one of said notches.

27. A ski boot according to claim 16, said hooking element being adjustable and consisting of a hook hinged in relation to the rear part of the boot.

28. A ski boot according to claim 27, wherein said hook comprises a plurality of notches serving to adjust the tension of said foot-retaining system.

29. A ski boot according to claim 6, wherein said hinged part comprises a means of adjusting the tension of the foot-retaining system.

30. A ski boot according to claim 29, wherein said adjusting means is detachable from the boot.

31. A ski boot according to claim 29, wherein said connecting means are hooked to a hooking element connected to the hinged part of the boot through the adjusting means.

32. A ski boot according to claim 29, wherein said adjusting means is permanently connected to said connecting means.

33. A ski boot according to claim 32, wherein said adjusting means is in the form of a threaded rod, adapted to rotate about its axis, and a nut.

34. A ski boot according to claim 33, wherein said hooking element is integral with said nut.

35. A ski boot according to claim 29, wherein said adjusting element is mounted detachably upon the back of the hinged part by means of a finger engaging in a recess integral with the hinged part; said hinged part being hinged in such a manner as to close off the rear of the boot.

* * * * *